US008919323B2

(12) United States Patent
Kar et al.

(10) Patent No.: US 8,919,323 B2
(45) Date of Patent: Dec. 30, 2014

(54) SYSTEM AND METHOD FOR CONTROLLING ENGINE SPEED

(75) Inventors: Krishnendu Kar, South Lyon, MI (US); Leon Cribbins, Dexter, MI (US)

(73) Assignee: GM Global Technology Operations LLC

( * ) Notice: Subject to any disclaimer, the term of this patent is extended or adjusted under 35 U.S.C. 154(b) by 365 days.

(21) Appl. No.: 13/431,317

(22) Filed: Mar. 27, 2012

(65) Prior Publication Data

US 2013/0255625 A1 Oct. 3, 2013

(51) Int. Cl.
*F02D 43/04* (2006.01)
*F02D 43/00* (2006.01)

(52) U.S. Cl.
CPC ..... *F02D 43/04* (2013.01); *F02D 43/00* (2013.01)
USPC ..... 123/352; 123/696

(58) Field of Classification Search
CPC ..... F02D 43/04; F02D 43/00
USPC ..... 123/319, 350, 352, 399, 696; 701/54, 701/101, 102, 110
See application file for complete search history.

(56) References Cited

U.S. PATENT DOCUMENTS 6,701,246 B2 * 3/2004 Riedle et al. ..... 701/110
7,524,255 B2 * 4/2009 Matthews ..... 475/54
2004/0214687 A1 * 10/2004 Morisawa et al. ..... 477/109

* cited by examiner

*Primary Examiner* — Mahmoud Gimie

(57) ABSTRACT

A system according to the principles of the present disclosure includes a gain determination module, a desired torque determination module, and an engine operation control module. The gain determination module determines a gain based on a desired speed of an engine and a change rate of an actual speed of the engine. The desired torque determination module determines a desired torque based on the gain and a difference between the actual speed and the desired speed. The engine operation control module controls at least one of a throttle area, a spark timing, and a fueling rate based on the desired torque.

20 Claims, 7 Drawing Sheets

SYSTEM AND METHOD FOR CONTROLLING ENGINE SPEED

FIELD

The present disclosure relates to internal combustion engines, and more particularly, to systems and methods for controlling engine speed.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

Internal combustion engines combust an air and fuel mixture within cylinders to drive pistons, which produces drive torque. Air flow into the engine is regulated via a throttle. More specifically, the throttle adjusts the throttle area, which increases or decreases air flow into the engine. As the throttle area increases, the air flow into the engine increases. A fuel control system adjusts the rate that fuel is injected to provide a desired air/fuel mixture to the cylinders and/or to achieve a desired torque output. Increasing the amount of air and fuel provided to the cylinders increases the torque output of the engine.

In spark-ignition engines, spark initiates combustion of an air/fuel mixture provided to the cylinders. In compression-ignition engines, compression in the cylinders combusts the air/fuel mixture provided to the cylinders. Spark timing and air flow may be the primary mechanisms for adjusting the torque output of spark-ignition engines, while fuel flow may be the primary mechanism for adjusting the torque output of compression-ignition engines.

Engine control systems have been developed to control engine output torque to achieve a desired torque. Traditional engine control systems, however, do not control the engine output torque as accurately as desired. Further, traditional engine control systems do not provide a rapid response to control signals or coordinate engine torque control among various devices that affect the engine output torque.

SUMMARY

A system according to the principles of the present disclosure includes a gain determination module, a desired torque determination module, and an engine operation control module. The gain determination module determines a gain based on a desired speed of an engine and a change rate of an actual speed of the engine. The desired torque determination module determines a desired torque based on the gain and a difference between the actual speed and the desired speed. The engine operation control module controls at least one of a throttle area, a spark timing, and a fueling rate based on the desired torque.

Further areas of applicability of the present disclosure will become apparent from the detailed description provided hereinafter. It should be understood that the detailed description and specific examples are intended for purposes of illustration only and are not intended to limit the scope of the disclosure.

BRIEF DESCRIPTION OF THE DRAWINGS

The present disclosure will become more fully understood from the detailed description and the accompanying drawings, wherein.

DETAILED DESCRIPTION

Figure 1:
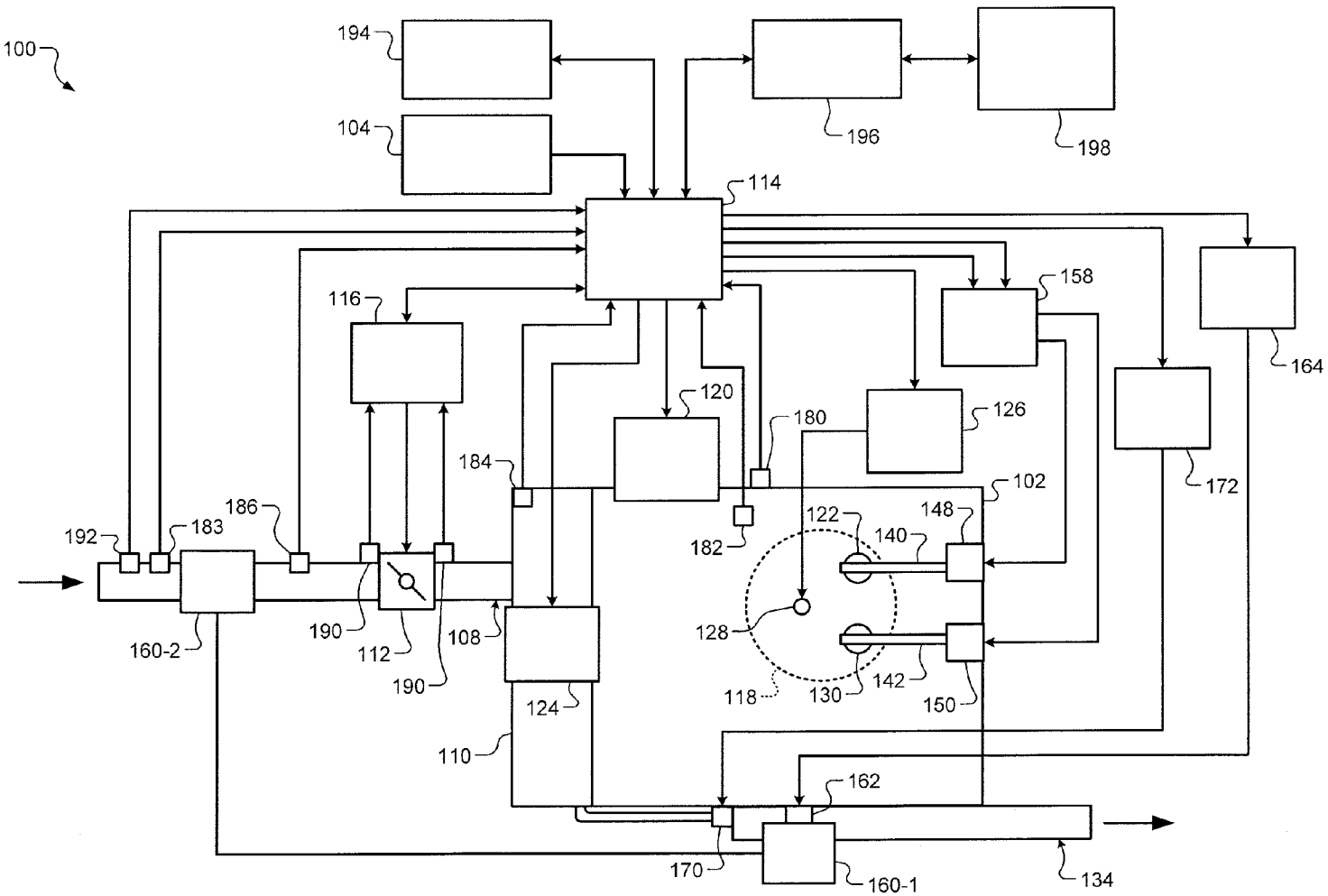
FIG. 1 is a functional block diagram of an example engine system according to the principles of the present disclosure.

An engine control module (ECM) may operate in a speed mode in which the ECM maintains an actual speed of an engine at a desired speed. The ECM may control the actual speed by adjusting actuator values such as throttle area, spark timing, and/or fueling rate. The speed mode may be enabled when the engine is idling. If a load is applied to the engine when the speed mode is enabled, the actual speed may decrease to less than the desired speed. This may be referred to as engine speed droop.

The load applied to the engine may be a known load or an unknown load depending on whether the ECM is informed of the load before the load is applied. The ECM may compensate for a known load to prevent a stall by increasing an idle speed and/or creating a torque reserve before the load is applied. A torque reserve may be created by retarding spark timing and compensating for the resulting torque reduction by adjusting other actuator values. The ECM may then maintain speed by advancing spark timing when the load is applied. However, increasing the idle speed or creating a torque reserve reduces fuel economy, and retarding spark timing may cause misfire.

The type of load applied to the engine may affect the response time from when the load is applied to when the actual speed is increased to the desired speed. The torque reserve and the idle speed are typically adjusted based on known loads. However, unknown loads such as power steering loads or generator loads may increase engine load by more than 100 percent, which may cause a stall. Thus, the torque reserve and the idle speed may be increased to compensate for unknown loads, causing a greater reduction in fuel economy relative to compensating for known loads. In addition, the response time may be greater when an unknown load is applied than when a known load is applied, causing the engine speed droop to be more noticeable.

A control system and method according to the principles of the present disclosure improves the response time when a load is applied so that the torque reserve and the idle speed may be decreased without increasing the engine speed droop. For example, when a driver turns a steering wheel while an engine is idling, the steering maneuver may cause a bend in power steering lines that increases power steering loads. This may be referred to as power steering cramp. If the driver turns the steering wheel when the engine is idling at 550 revolutions per minute (RPM) and the torque reserve is set to 12 Newton meters (Nm), the steering maneuver may cause a power steering cramp that stalls the engine. However, a control system and method according to the present disclosure may prevent the engine from stalling under these conditions.

A control system and method according to the present disclosure may improve the response time by operating in a transient mode under certain conditions. The transient mode may be enabled when a rate of change of engine speed is greater than a first rate and a pressure ratio across a throttle valve is less than a first ratio. The engine speed may be sampled every firing period (i.e., every period between consecutive firing events). The first rate may be determined based on a desired speed, an accessory load such as an air conditioner compressor load, and/or whether a garage shift is in progress. A garage shift is a shift from park or neutral to drive or reverse.

To improve engine speed stability, the transient mode may not be enabled for a predetermined period after the transient mode is disabled. The first period may be predetermined based on a delay period from a first time when the throttle area is increased to a second time when a manifold pressure increases in response to the throttle area increase. The transient mode may be enabled for a predetermined period.

The actual torque produced by the engine may be maintained at a desired torque that yields a desired speed, and the actuator values may be adjusted based on the desired torque. To avoid a throttle area overshoot, the desired torque may not be adjusted faster than a first rate when the desired torque is greater than a first torque. Proportional and integral gains may be used to reduce the difference between the actual torque and the desired torque. The gains may be set to base values when the transient mode is disabled and set to values that are greater than the base values when the transient mode is enabled. Additionally, the gains may be determined based on the desired speed and the rate of change of engine speed to improve the response time.

The throttle area may be determined based on an actual manifold pressure for improved stability when the transient mode is disabled. The throttle area may be determined based on a desired manifold pressure when the transient mode is enabled. A cam phaser position may be optimized for fuel economy when the transient mode is disabled and may be optimized for torque output when the transient mode is enabled.

Referring now to FIG. 1, a functional block diagram of an example engine system 100 is presented. The engine system 100 includes an engine 102 that combusts an air/fuel mixture to produce drive torque for a vehicle based on driver input from a driver input module 104. Air is drawn into the engine 102 through an intake system 108. For example only, the intake system 108 may include an intake manifold 110 and a throttle valve 112. For example only, the throttle valve 112 may include a butterfly valve having a rotatable blade. An engine control module (ECM) 114 controls a throttle actuator module 116, which regulates opening of the throttle valve 112 to control the amount of air drawn into the intake manifold 110.

Air from the intake manifold 110 is drawn into cylinders of the engine 102. While the engine 102 may include multiple cylinders, for illustration purposes a single representative cylinder 118 is shown. For example only, the engine 102 may include 2, 3, 4, 5, 6, 8, 10, and/or 12 cylinders. The ECM 114 may instruct a cylinder actuator module 120 to selectively deactivate some of the cylinders, which may improve fuel economy under certain engine operating conditions.

The engine 102 may operate using a four-stroke cycle. The four strokes, described below, are named the intake stroke, the compression stroke, the combustion stroke, and the exhaust stroke. During each revolution of a crankshaft (not shown), two of the four strokes occur within the cylinder 118. Therefore, two crankshaft revolutions are necessary for the cylinder 118 to experience all four of the strokes.

During the intake stroke, air from the intake manifold 110 is drawn into the cylinder 118 through an intake valve 122. The ECM 114 controls a fuel actuator module 124, which regulates fuel injection to achieve a desired air/fuel ratio. Fuel may be injected into the intake manifold 110 at a central location or at multiple locations, such as near the intake valve 122 of each of the cylinders. In various implementations (not shown), fuel may be injected directly into the cylinders or into mixing chambers associated with the cylinders. The fuel actuator module 124 may halt injection of fuel to cylinders that are deactivated.

The injected fuel mixes with air and creates an air/fuel mixture in the cylinder 118. During the compression stroke, a piston (not shown) within the cylinder 118 compresses the air/fuel mixture. The engine 102 may be a compression-ignition engine, in which case compression in the cylinder 118 ignites the air/fuel mixture. Alternatively, the engine 102 may be a spark-ignition engine, in which case a spark actuator module 126 energizes a spark plug 128 in the cylinder 118 based on a signal from the ECM 114, which ignites the air/fuel mixture. The timing of the spark may be specified relative to the time when the piston is at its topmost position, referred to as top dead center (TDC).

The spark actuator module 126 may be controlled by a timing signal specifying how far before or after TDC to generate the spark. Because piston position is directly related to crankshaft rotation, operation of the spark actuator module 126 may be synchronized with crankshaft angle. In various implementations, the spark actuator module 126 may halt provision of spark to deactivated cylinders.

Generating the spark may be referred to as a firing event. The spark actuator module 126 may have the ability to vary the timing of the spark for each firing event. The spark actuator module 126 may even be capable of varying the spark timing for a next firing event when the spark timing signal is changed between a last firing event and the next firing event.

During the combustion stroke, the combustion of the air/fuel mixture drives the piston down, thereby driving the crankshaft. The combustion stroke may be defined as the time between the piston reaching TDC and the time at which the piston returns to bottom dead center (BDC).

During the exhaust stroke, the piston begins moving up from BDC and expels the byproducts of combustion through an exhaust valve 130. The byproducts of combustion are exhausted from the vehicle via an exhaust system 134.

The intake valve 122 may be controlled by an intake camshaft 140, while the exhaust valve 130 may be controlled by an exhaust camshaft 142. In various implementations, multiple intake camshafts (including the intake camshaft 140) may control multiple intake valves (including the intake valve 122) for the cylinder 118 and/or may control the intake valves (including the intake valve 122) of multiple banks of cylinders (including the cylinder 118). Similarly, multiple exhaust camshafts (including the exhaust camshaft 142) may control multiple exhaust valves for the cylinder 118 and/or may control exhaust valves (including the exhaust valve 130) for multiple banks of cylinders (including the cylinder 118).

The cylinder actuator module 120 may deactivate the cylinder 118 by disabling opening of the intake valve 122 and/or the exhaust valve 130. In various other implementations, the intake valve 122 and/or the exhaust valve 130 may be controlled by devices other than camshafts, such as electromagnetic actuators.

The time at which the intake valve 122 is opened may be varied with respect to piston TDC by an intake cam phaser 148. The time at which the exhaust valve 130 is opened may be varied with respect to piston TDC by an exhaust cam phaser 150. A phaser actuator module 158 may control the intake cam phaser 148 and the exhaust cam phaser 150 based on signals from the ECM 114. When implemented, variable valve lift (not shown) may also be controlled by the phaser actuator module 158.

The engine system 100 may include a boost device that provides pressurized air to the intake manifold 110. For example, FIG. 1 shows a turbocharger including a hot turbine 160-1 that is powered by hot exhaust gases flowing through the exhaust system 134. The turbocharger also includes a cold air compressor 160-2, driven by the turbine 160 1, that compresses air leading into the throttle valve 112. In various implementations, a supercharger (not shown), driven by the crankshaft, may compress air from the throttle valve 112 and deliver the compressed air to the intake manifold 110.

A wastegate 162 may allow exhaust to bypass the turbine 160 1, thereby reducing the boost (the amount of intake air compression) of the turbocharger. The ECM 114 may control the turbocharger via a boost actuator module 164. The boost actuator module 164 may modulate the boost of the turbocharger by controlling the position of the wastegate 162. In various implementations, multiple turbochargers may be controlled by the boost actuator module 164. The turbocharger may have variable geometry, which may be controlled by the boost actuator module 164.

An intercooler (not shown) may dissipate some of the heat contained in the compressed air charge, which is generated as the air is compressed. The compressed air charge may also have absorbed heat from components of the exhaust system 134. Although shown separated for purposes of illustration, the turbine 160-1 and the compressor 160-2 may be attached to each other, placing intake air in close proximity to hot exhaust.

The engine system 100 may include an exhaust gas recirculation (EGR) valve 170, which selectively redirects exhaust gas back to the intake manifold 110. The EGR valve 170 may be located upstream of the turbocharger's turbine 160-1. The EGR valve 170 may be controlled by an EGR actuator module 172.

The engine system 100 may measure the speed of the crankshaft in revolutions per minute (RPM) using an RPM sensor 180. The temperature of the engine coolant may be measured using an engine coolant temperature (ECT) sensor 182. The ECT sensor 182 may be located within the engine 102 or at other locations where the coolant is circulated, such as a radiator (not shown).

Ambient air pressure may be measured using an ambient air pressure (AAP) sensor 183. The pressure within the intake manifold 110 may be measured using a manifold absolute pressure (MAP) sensor 184. In various implementations, engine vacuum, which is the difference between the ambient air pressure and the pressure within the intake manifold 110, may be measured. The mass flow rate of air flowing into the intake manifold 110 may be measured using a mass air flow (MAF) sensor 186. In various implementations, the MAF sensor 186 may be located in a housing that also includes the throttle valve 112.

The throttle actuator module 116 may monitor the position of the throttle valve 112 using one or more throttle position sensors (TPS) 190. The ambient temperature of air being drawn into the engine 102 may be measured using an intake air temperature (IAT) sensor 192. The ECM 114 may use signals from the sensors to make control decisions for the engine system 100.

The ECM 114 may communicate with a transmission control module 194 to coordinate shifting gears in a transmission (not shown). For example, the ECM 114 may reduce engine torque during a gear shift. The ECM 114 may communicate with a hybrid control module 196 to coordinate operation of the engine 102 and an electric motor 198.

The electric motor 198 may also function as a generator, and may be used to produce electrical energy for use by vehicle electrical systems and/or for storage in a battery. In various implementations, various functions of the ECM 114, the transmission control module 194, and the hybrid control module 196 may be integrated into one or more modules.

Each system that varies an engine parameter may be referred to as an actuator that receives an actuator value. For example, the throttle actuator module 116 may be referred to as an actuator and the throttle opening area may be referred to as the actuator value. In the example of FIG. 1, the throttle actuator module 116 achieves the throttle opening area by adjusting an angle of the blade of the throttle valve 112.

Similarly, the spark actuator module 126 may be referred to as an actuator, while the corresponding actuator value may be the amount of spark advance relative to cylinder TDC. Other actuators may include the cylinder actuator module 120, the fuel actuator module 124, the phaser actuator module 158, the boost actuator module 164, and the EGR actuator module 172. For these actuators, the actuator values may correspond to number of activated cylinders, fueling rate, intake and exhaust cam phaser angles, boost pressure, and EGR valve opening area, respectively. The ECM 114 may control actuator values in order to cause the engine 102 to generate a desired engine output torque.

Figure 2:
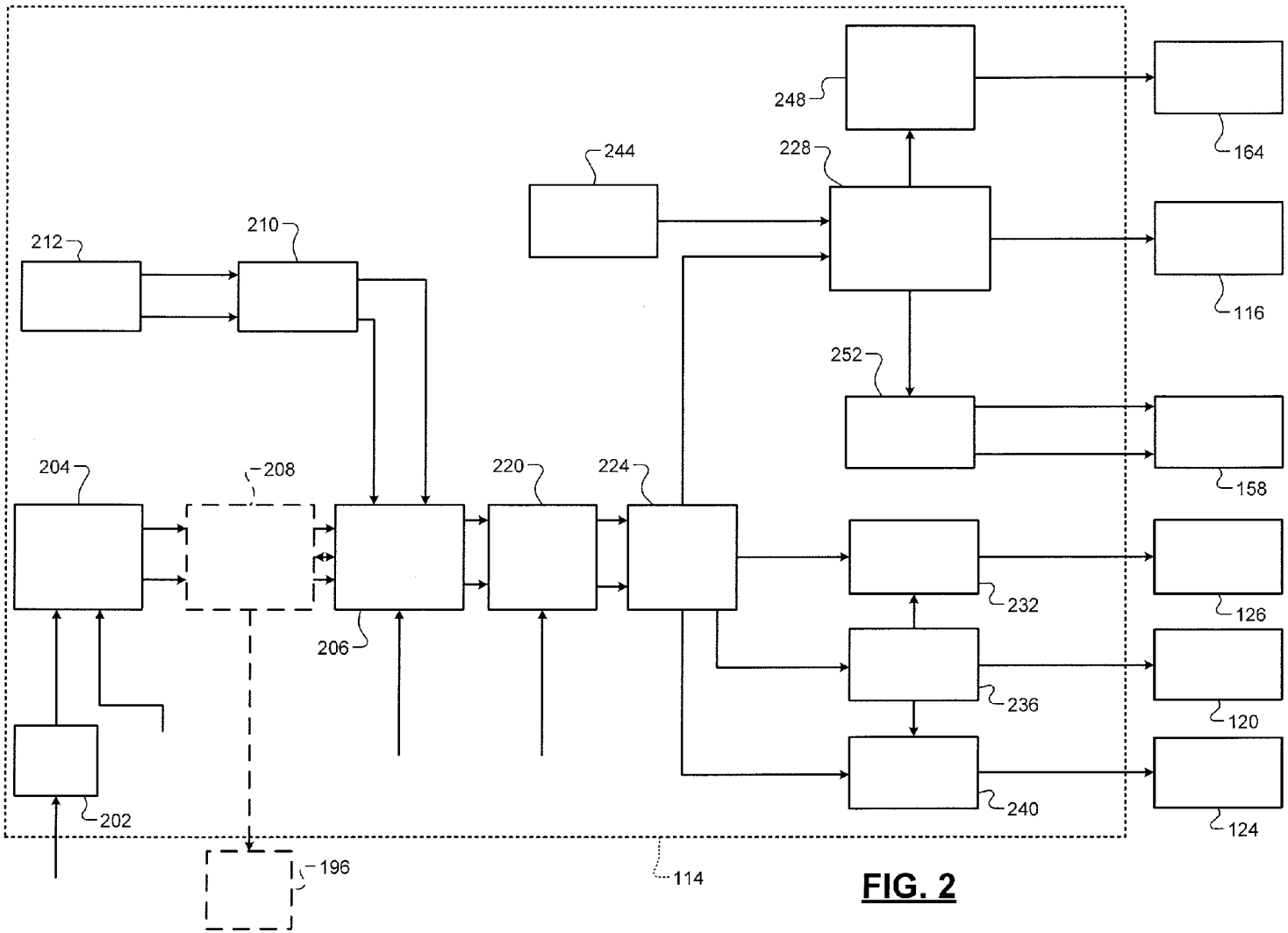
FIG. 2 is a functional block diagram of an example engine control system according to the principles of the present disclosure.

Referring now to FIG. 2, a functional block diagram of an example engine control system is presented. An example implementation of the ECM 114 includes a driver torque module 202. The driver torque module 202 may determine a driver torque request based on a driver input from the driver input module 104. The driver input may be based on a position of an accelerator pedal. The driver input may also be based on cruise control, which may be an adaptive cruise control system that varies vehicle speed to maintain a predetermined following distance. The driver torque module 202 may store one or more mappings of accelerator pedal position to desired torque, and may determine the driver torque request based on a selected one of the mappings.

An axle torque arbitration module 204 arbitrates between the driver torque request from the driver torque module 202 and other axle torque requests. Axle torque (torque at the wheels) may be produced by various sources including an engine and/or an electric motor. Torque requests may include absolute torque requests as well as relative torque requests and ramp requests. For example only, ramp requests may include a request to ramp torque down to a minimum engine off torque or to ramp torque up from the minimum engine off torque. Relative torque requests may include temporary or persistent torque reductions or increases.

Axle torque requests may include a torque reduction requested by a traction control system when positive wheel slip is detected. Positive wheel slip occurs when axle torque overcomes friction between the wheels and the road surface, and the wheels begin to slip against the road surface. Axle torque requests may also include a torque increase request to counteract negative wheel slip, where a tire of the vehicle slips with respect to the road surface because the axle torque is negative.

Axle torque requests may also include brake management requests and vehicle over-speed torque requests. Brake management requests may reduce axle torque to ensure that the axle torque does not exceed the ability of the brakes to hold the vehicle when the vehicle is stopped. Vehicle over-speed torque requests may reduce the axle torque to prevent the vehicle from exceeding a predetermined speed. Axle torque requests may also be generated by vehicle stability control systems.

The axle torque arbitration module 204 outputs a predicted torque request and an immediate torque request based on the results of arbitrating between the received torque requests. As described below, the predicted and immediate torque requests from the axle torque arbitration module 204 may selectively be adjusted by other modules of the ECM 114 before being used to control actuators of the engine system 100.

In general terms, the immediate torque request is the amount of currently desired axle torque, while the predicted torque request is the amount of axle torque that may be needed on short notice. The ECM 114 therefore controls the engine system 100 to produce an axle torque equal to the immediate torque request. However, different combinations of actuator values may result in the same axle torque. The ECM 114 may therefore adjust the actuator values to allow a faster transition to the predicted torque request, while still maintaining the axle torque at the immediate torque request.

In various implementations, the predicted torque request may be based on the driver torque request. The immediate torque request may be less than the predicted torque request, such as when the driver torque request is causing wheel slip on an icy surface. In such a case, a traction control system (not shown) may request a reduction via the immediate torque request, and the ECM 114 reduces the torque produced by the engine system 100 to the immediate torque request. However, the ECM 114 controls the engine system 100 so that the engine system 100 can quickly resume producing the predicted torque request once the wheel slip stops.

In general terms, the difference between the immediate torque request and the higher predicted torque request can be referred to as a torque reserve. The torque reserve may represent the amount of additional torque that the engine system 100 can begin to produce with minimal delay. Fast engine actuators are used to increase or decrease current axle torque. As described in more detail below, fast engine actuators are defined in contrast with slow engine actuators.

In various implementations, fast engine actuators are capable of varying axle torque within a range, where the range is established by the slow engine actuators. In such implementations, the upper limit of the range is the predicted torque request, while the lower limit of the range is limited by the torque capacity of the fast actuators. For example only, fast actuators may only be able to reduce axle torque by a first amount, where the first amount is a measure of the torque capacity of the fast actuators. The first amount may vary based on engine operating conditions set by the slow engine actuators. When the immediate torque request is within the range, fast engine actuators can be set to cause the axle torque to be equal to the immediate torque request. When the ECM 114 requests the predicted torque request to be output, the fast engine actuators can be controlled to vary the axle torque to the top of the range, which is the predicted torque request.

In general terms, fast engine actuators can more quickly change the axle torque when compared to slow engine actuators. Slow actuators may respond more slowly to changes in their respective actuator values than fast actuators do. For example, a slow actuator may include mechanical components that require time to move from one position to another in response to a change in actuator value. A slow actuator may also be characterized by the amount of time it takes for the axle torque to begin to change once the slow actuator begins to implement the changed actuator value. Generally, this amount of time will be longer for slow actuators than for fast actuators. In addition, even after beginning to change, the axle torque may take longer to fully respond to a change in a slow actuator.

For example only, the ECM 114 may set actuator values for slow actuators to values that would enable the engine system 100 to produce the predicted torque request if the fast actuators were set to appropriate values. Meanwhile, the ECM 114 may set actuator values for fast actuators to values that, given the slow actuator values, cause the engine system 100 to produce the immediate torque request instead of the predicted torque request.

The fast actuator values therefore cause the engine system 100 to produce the immediate torque request. When the ECM 114 decides to transition the axle torque from the immediate torque request to the predicted torque request, the ECM 114 changes the actuator values for one or more fast actuators to values that correspond to the predicted torque request. Because the slow actuator values have already been set based on the predicted torque request, the engine system 100 is able to produce the predicted torque request after only the delay imposed by the fast actuators. In other words, the longer delay that would otherwise result from changing axle torque using slow actuators is avoided.

For example only, when the predicted torque request is equal to the driver torque request, a torque reserve may be created when the immediate torque request is less than the driver torque request due to a temporary torque reduction request. Alternatively, a torque reserve may be created by increasing the predicted torque request above the driver torque request while maintaining the immediate torque request at the driver torque request. The resulting torque reserve can absorb sudden increases in required axle torque. For example only, sudden loads from an air conditioner or a power steering pump may be counterbalanced by increasing the immediate torque request. If the increase in immediate torque request is less than the torque reserve, the increase can be quickly produced by using fast actuators. The predicted torque request may then also be increased to re-establish the previous torque reserve.

Another example use of a torque reserve is to reduce fluctuations in slow actuator values. Because of their relatively slow speed, varying slow actuator values may produce control instability. In addition, slow actuators may include mechanical parts, which may draw more power and/or wear more quickly when moved frequently. Creating a sufficient torque reserve allows changes in desired torque to be made by varying fast actuators via the immediate torque request while maintaining the values of the slow actuators. For example, to maintain a given idle speed, the immediate torque request may vary within a range. If the predicted torque request is set to a level above this range, variations in the immediate torque request that maintain the idle speed can be made using fast actuators without the need to adjust slow actuators.

For example only, in a spark-ignition engine, spark timing may be a fast actuator value, while throttle opening area may be a slow actuator value. Spark-ignition engines may combust fuels including, for example, gasoline and ethanol, by applying a spark. By contrast, in a compression-ignition engine, fuel flow may be a fast actuator value, while throttle opening area may be used as an actuator value for engine characteristics other than torque. Compression-ignition engines may combust fuels including, for example, diesel, by compressing the fuels.

When the engine 102 is a spark-ignition engine, the spark actuator module 126 may be a fast actuator and the throttle actuator module 116 may be a slow actuator. After receiving a new actuator value, the spark actuator module 126 may be able to change spark timing for the following firing event. When the spark timing (also called spark advance) for a firing event is set to a calibrated value, maximum torque is produced in the combustion stroke immediately following the firing event. However, a spark advance deviating from the calibrated value may reduce the amount of torque produced in the combustion stroke. Therefore, the spark actuator module 126 may be able to vary engine output torque as soon as the next firing event occurs by varying spark advance. For example only, a table of spark advances corresponding to different engine operating conditions may be determined during a calibration phase of vehicle design, and the calibrated value is selected from the table based on current engine operating conditions.

By contrast, changes in throttle opening area take longer to affect engine output torque. The throttle actuator module 116 changes the throttle opening area by adjusting the angle of the blade of the throttle valve 112. Therefore, once a new actuator value is received, there is a mechanical delay as the throttle valve 112 moves from its previous position to a new position based on the new actuator value. In addition, air flow changes based on the throttle valve opening are subject to air transport delays in the intake manifold 110. Further, increased air flow in the intake manifold 110 is not realized as an increase in engine output torque until the cylinder 118 receives additional air in the next intake stroke, compresses the additional air, and commences the combustion stroke.

Using these actuators as an example, a torque reserve can be created by setting the throttle opening area to a value that would allow the engine 102 to produce a predicted torque request. Meanwhile, the spark timing can be set based on an immediate torque request that is less than the predicted torque request. Although the throttle opening area generates enough air flow for the engine 102 to produce the predicted torque request, the spark timing is retarded (which reduces torque) based on the immediate torque request. The engine output torque will therefore be equal to the immediate torque request.

When additional torque is needed, such as when the air conditioning compressor is started, or when traction control determines wheel slip has ended, the spark timing can be set based on the predicted torque request. By the following firing event, the spark actuator module 126 may return the spark advance to a calibrated value, which allows the engine 102 to produce the full engine output torque achievable with the air flow already present. The engine output torque may therefore be quickly increased to the predicted torque request without experiencing delays from changing the throttle opening area.

When the engine 102 is a compression-ignition engine, the fuel actuator module 124 may be a fast actuator and the throttle actuator module 116 and the boost actuator module 164 may be emissions actuators. In this manner, the fuel mass may be set based on the immediate torque request, and the throttle opening area and boost may be set based on the predicted torque request. The throttle opening area may generate more air flow than necessary to satisfy the predicted torque request. In turn, the air flow generated may be more than required for complete combustion of the injected fuel such that the air/fuel ratio is usually lean and changes in air flow do not affect the engine torque output. The engine output torque will therefore be equal to the immediate torque request and may be increased or decreased by adjusting the fuel flow.

The throttle actuator module 116, the boost actuator module 164, and the EGR actuator module 172 may be controlled based on the predicted torque request to control emissions and to minimize turbo lag. The throttle actuator module 116 may create a vacuum to draw exhaust gases through the EGR valve 170 and into the intake manifold 110.

The axle torque arbitration module 204 may output the predicted torque request and the immediate torque request to a propulsion torque arbitration module 206. In various implementations, the axle torque arbitration module 204 may output the predicted and immediate torque requests to a hybrid optimization module 208. The hybrid optimization module 208 determines how much torque should be produced by the engine 102 and how much torque should be produced by the electric motor 198. The hybrid optimization module 208 then outputs modified predicted and immediate torque requests to the propulsion torque arbitration module 206. In various implementations, the hybrid optimization module 208 may be implemented in the hybrid control module 196.

The predicted and immediate torque requests received by the propulsion torque arbitration module 206 are converted from an axle torque domain (torque at the wheels) into a propulsion torque domain (torque at the crankshaft). This conversion may occur before, after, as part of, or in place of the hybrid optimization module 208.

The propulsion torque arbitration module 206 arbitrates between propulsion torque requests, including the converted predicted and immediate torque requests. The propulsion torque arbitration module 206 generates an arbitrated predicted torque request and an arbitrated immediate torque request. The arbitrated torques may be generated by selecting a winning request from among received requests. Alternatively or additionally, the arbitrated torques may be generated by modifying one of the received requests based on another one or more of the received requests.

Other propulsion torque requests may include torque reductions for engine over-speed protection, torque increases for stall prevention, and torque reductions requested by the transmission control module 194 to accommodate gear shifts. Propulsion torque requests may also result from clutch fuel cutoff, which reduces the engine output torque when the driver depresses the clutch pedal in a manual transmission vehicle to prevent a flare (rapid rise) in engine speed.

Propulsion torque requests may also include an engine shutoff request, which may be initiated when a critical fault is detected. For example only, critical faults may include detection of vehicle theft, a stuck starter motor, electronic throttle control problems, and unexpected torque increases. In various implementations, when an engine shutoff request is present, arbitration selects the engine shutoff request as the winning request. When the engine shutoff request is present, the propulsion torque arbitration module 206 may output zero as the arbitrated torques.

In various implementations, an engine shutoff request may simply shut down the engine 102 separately from the arbitration process. The propulsion torque arbitration module 206 may still receive the engine shutoff request so that, for example, appropriate data can be fed back to other torque requestors. For example, all other torque requestors may be informed that they have lost arbitration.

A speed control module 210 may also output predicted and immediate torque requests to the propulsion torque arbitration module 206. The torque requests from the speed control module 210 may prevail in arbitration when the ECM 114 is in a speed mode. Speed mode may be enabled when the driver removes their foot from the accelerator pedal, such as when the engine 102 is idling or when the vehicle is coasting down from a higher speed. Alternatively or additionally, speed mode may be enabled when the predicted torque request from the axle torque arbitration module 204 is less than a predetermined torque value.

The speed control module 210 receives an actual speed and a desired speed from a speed trajectory module 212, and controls the predicted and immediate torque requests to reduce the difference between the actual speed and the desired speed. For example only, the speed trajectory module 212 may output a linearly decreasing desired speed for vehicle coastdown until an idle speed is reached. The speed trajectory module 212 may then continue outputting the idle speed as the desired speed. In the preceding example, the linearly decreasing desired speed may be referred to as a reference speed and the idle speed may be referred to as the desired speed. The speed control module 210 may receive both the reference speed and the desired speed from the speed trajectory module 212.

A reserves/loads module 220 receives the arbitrated predicted and immediate torque requests from the propulsion torque arbitration module 206. The reserves/loads module 220 may adjust the arbitrated predicted and immediate torque requests to create a torque reserve and/or to compensate for one or more loads. The reserves/loads module 220 then outputs the adjusted predicted and immediate torque requests to an actuation module 224. The actuation module 224 may be referred to as an engine operation control module.

For example only, a catalyst light-off process or a cold start emissions reduction process may require retarded spark advance. The reserves/loads module 220 may therefore increase the adjusted predicted torque request above the adjusted immediate torque request to create retarded spark for the cold start emissions reduction process. In another example, the air/fuel ratio of the engine and/or the mass air flow may be directly varied, such as by diagnostic intrusive equivalence ratio testing and/or new engine purging. Before beginning these processes, a torque reserve may be created or increased to quickly offset decreases in engine output torque that result from leaning the air/fuel mixture during these processes.

The reserves/loads module 220 may also create or increase a torque reserve in anticipation of a future load, such as power steering pump operation or engagement of an air conditioning (NC) compressor clutch. The reserve for engagement of the A/C compressor clutch may be created when the driver first requests air conditioning. The reserves/loads module 220 may increase the adjusted predicted torque request while leaving the adjusted immediate torque request unchanged to produce the torque reserve. Then, when the NC compressor clutch engages, the reserves/loads module 220 may increase the immediate torque request by the estimated load of the NC compressor clutch.

The actuation module 224 receives the adjusted predicted and immediate torque requests from the reserves/loads module 220. The actuation module 224 determines how the adjusted predicted and immediate torque requests will be achieved. The actuation module 224 may be engine type specific. For example, the actuation module 224 may be implemented differently or use different control schemes for spark-ignition engines versus compression-ignition engines.

In various implementations, the actuation module 224 may define a boundary between modules that are common across all engine types and modules that are engine type specific. For example, engine types may include spark-ignition and compression-ignition. Modules prior to the actuation module 224, such as the propulsion torque arbitration module 206, may be common across engine types, while the actuation module 224 and subsequent modules may be engine type specific.

For example, in a spark-ignition engine, the actuation module 224 may vary the opening of the throttle valve 112 as a slow actuator that allows for a wide range of torque control. The actuation module 224 may disable cylinders using the cylinder actuator module 120, which also provides for a wide range of torque control, but may also be slow and may involve drivability and emissions concerns. The actuation module 224 may use spark timing as a fast actuator. However, spark timing may not provide as much range of torque control. In addition, the amount of torque control possible with changes in spark timing (referred to as spark reserve capacity) may vary as air flow changes.

In various implementations, the actuation module 224 may generate an air torque request based on the adjusted predicted torque request. The air torque request may be equal to the adjusted predicted torque request, setting air flow so that the adjusted predicted torque request can be achieved by changes to other actuators.

An air control module 228 may determine desired actuator values based on the air torque request. For example, the air control module 228 may control desired manifold absolute pressure (MAP), desired throttle area, and/or desired air per cylinder (APC). Desired MAP may be used to determine desired boost, and desired APC may be used to determine desired cam phaser positions. In various implementations, the air control module 228 may also determine an amount of opening of the EGR valve 170.

The actuation module 224 may also generate a spark torque request, a cylinder shut-off torque request, and a fuel torque request. The spark torque request may be used by a spark control module 232 to determine how much to retard the spark timing (which reduces engine output torque) from a calibrated spark advance.

The cylinder shut-off torque request may be used by a cylinder control module 236 to determine how many cylinders to deactivate. The cylinder control module 236 may instruct the cylinder actuator module 120 to deactivate one or more cylinders of the engine 102. In various implementations, a predefined group of cylinders may be deactivated jointly.

The cylinder control module 236 may also instruct a fuel control module 240 to stop providing fuel for deactivated cylinders and may instruct the spark control module 232 to stop providing spark for deactivated cylinders. In various implementations, the spark control module 232 only stops providing spark for a cylinder once any fuel/air mixture already present in the cylinder has been combusted.

In various implementations, the cylinder actuator module 120 may include a hydraulic system that selectively decouples intake and/or exhaust valves from the corresponding camshafts for one or more cylinders in order to deactivate those cylinders. For example only, valves for half of the cylinders are either hydraulically coupled or decoupled as a group by the cylinder actuator module 120. In various implementations, cylinders may be deactivated simply by halting provision of fuel to those cylinders, without stopping the opening and closing of the intake and exhaust valves. In such implementations, the cylinder actuator module 120 may be omitted.

The fuel control module 240 may vary the amount of fuel provided to each cylinder based on the fuel torque request from the actuation module 224. During normal operation of a spark-ignition engine, the fuel control module 240 may operate in an air lead mode in which the fuel control module 240 attempts to maintain a stoichiometric air/fuel ratio by controlling fuel flow based on air flow. The fuel control module 240 may determine a fuel mass that will yield stoichiometric combustion when combined with the current amount of air per cylinder. The fuel control module 240 may instruct the fuel actuator module 124 via the fueling rate to inject this fuel mass for each activated cylinder.

In compression-ignition systems, the fuel control module 240 may operate in a fuel lead mode in which the fuel control module 240 determines a fuel mass for each cylinder that satisfies the fuel torque request while minimizing emissions, noise, and fuel consumption. In the fuel lead mode, air flow is controlled based on fuel flow and may be controlled to yield a lean air/fuel ratio. In addition, the air/fuel ratio may be maintained above a predetermined level, which may prevent black smoke production in dynamic engine operating conditions.

A mode setting may determine how the actuation module 224 treats the adjusted immediate torque request. The mode setting may be provided to the actuation module 224, such as by the propulsion torque arbitration module 206, and may select modes including an inactive mode, a pleasible mode, a maximum range mode, and an auto actuation mode.

In the inactive mode, the actuation module 224 may ignore the adjusted immediate torque request and set engine output torque based on the adjusted predicted torque request. The actuation module 224 may therefore set the spark torque request, the cylinder shut-off torque request, and the fuel torque request to the adjusted predicted torque request, which maximizes engine output torque for the current engine air flow conditions. Alternatively, the actuation module 224 may set these requests to predetermined (such as out-of-range high) values to disable torque reductions from retarding spark, deactivating cylinders, or reducing the fuel/air ratio.

In the pleasible mode, the actuation module 224 outputs the adjusted predicted torque request as the air torque request and attempts to achieve the adjusted immediate torque request by adjusting only spark advance. The actuation module 224 therefore outputs the adjusted immediate torque request as the spark torque request. The spark control module 232 will retard the spark as much as possible to attempt to achieve the spark torque request. If the desired torque reduction is greater than the spark reserve capacity (the amount of torque reduction achievable by spark retard), the torque reduction may not be achieved. The engine output torque will then be greater than the adjusted immediate torque request.

In the maximum range mode, the actuation module 224 may output the adjusted predicted torque request as the air torque request and the adjusted immediate torque request as the spark torque request. In addition, the actuation module 224 may decrease the cylinder shut-off torque request (thereby deactivating cylinders) when reducing spark advance alone is unable to achieve the adjusted immediate torque request.

In the auto actuation mode, the actuation module 224 may decrease the air torque request based on the adjusted immediate torque request. In various implementations, the air torque request may be reduced only so far as is necessary to allow the spark control module 232 to achieve the adjusted immediate torque request by adjusting spark advance. Therefore, in auto actuation mode, the adjusted immediate torque request is achieved while adjusting the air torque request as little as possible. In other words, the use of relatively slowly-responding throttle valve opening is minimized by reducing the quickly-responding spark advance as much as possible. This allows the engine 102 to return to producing the adjusted predicted torque request as quickly as possible.

A torque estimation module 244 may estimate torque output of the engine 102. This estimated torque may be used by the air control module 228 to perform closed-loop control of engine air flow parameters, such as throttle area, MAP, and phaser positions. For example, a torque relationship such as $$T=f(APC,S,I,E,AF,OT,\#) \quad (1)$$

may be defined, where torque (T) is a function of air per cylinder (APC), spark advance (S), intake cam phaser position (I), exhaust cam phaser position (E), air/fuel ratio (AF), oil temperature (OT), and number of activated cylinders (#). Additional variables may also be accounted for, such as the degree of opening of an exhaust gas recirculation (EGR) valve.

This relationship may be modeled by an equation and/or may be stored as a lookup table. The torque estimation module 244 may determine APC based on measured MAF and current RPM, thereby allowing closed loop air control based on actual air flow. The intake and exhaust cam phaser positions used may be based on actual positions, as the phasers may be traveling toward desired positions.

The actual spark advance may be used to estimate the actual engine output torque. When a calibrated spark advance value is used to estimate torque, the estimated torque may be called an estimated air torque, or simply air torque. The air torque is an estimate of how much torque the engine could generate at the current air flow if spark retard was removed (i.e., spark timing was set to the calibrated spark advance value) and all cylinders were fueled.

The air control module 228 may output a desired throttle area to the throttle actuator module 116. The throttle actuator module 116 then regulates the throttle valve 112 to produce the desired throttle area. The air control module 228 may determine the desired throttle area based on an inverse torque model and the air torque request. The air control module 228 may use the estimated air torque and/or the MAF signal in order to perform closed loop control. For example, the desired throttle area may be controlled to minimize a difference between the estimated air torque and the air torque request.

The air control module 228 may output a desired manifold absolute pressure (MAP) signal to a boost scheduling module 248. The boost scheduling module 248 uses the desired MAP signal to control the boost actuator module 164. The boost actuator module 164 then controls one or more turbochargers (e.g., the turbocharger including the turbine 160-1 and the compressor 160-2) and/or superchargers.

The air control module 228 may also output a desired air per cylinder (APC) signal to a phaser scheduling module 252. Based on the desired APC signal and the RPM signal, the phaser scheduling module 252 may control positions of the intake and/or exhaust cam phasers 148 and 150 using the phaser actuator module 158.

Referring back to the spark control module 232, calibrated spark advance values may vary based on various engine operating conditions. For example only, a torque relationship may be inverted to solve for desired spark advance. For a given torque request ($T_{des}$), the desired spark advance ($S_{des}$) may be determined based on $$S_{des}=f^{-1}(T_{des},APC,I,E,AF,OT,\#). \quad (2)$$

This relationship may be embodied as an equation and/or as a lookup table. The air/fuel ratio may be the actual air/fuel ratio, as reported by the fuel control module 240.

When the spark advance is set to the calibrated spark advance, the resulting torque may be as close to mean best torque (MBT) as possible. MBT refers to the maximum engine output torque that is generated for a given air flow as spark advance is increased, while using fuel having an octane rating greater than a predetermined threshold and using stoichiometric fueling. The spark advance at which this maximum torque occurs is referred to as MBT spark. The calibrated spark advance may differ slightly from MBT spark because of, for example, fuel quality (such as when lower octane fuel is used) and environmental factors. The torque at the calibrated spark advance may therefore be less than MBT.

Figure 3:
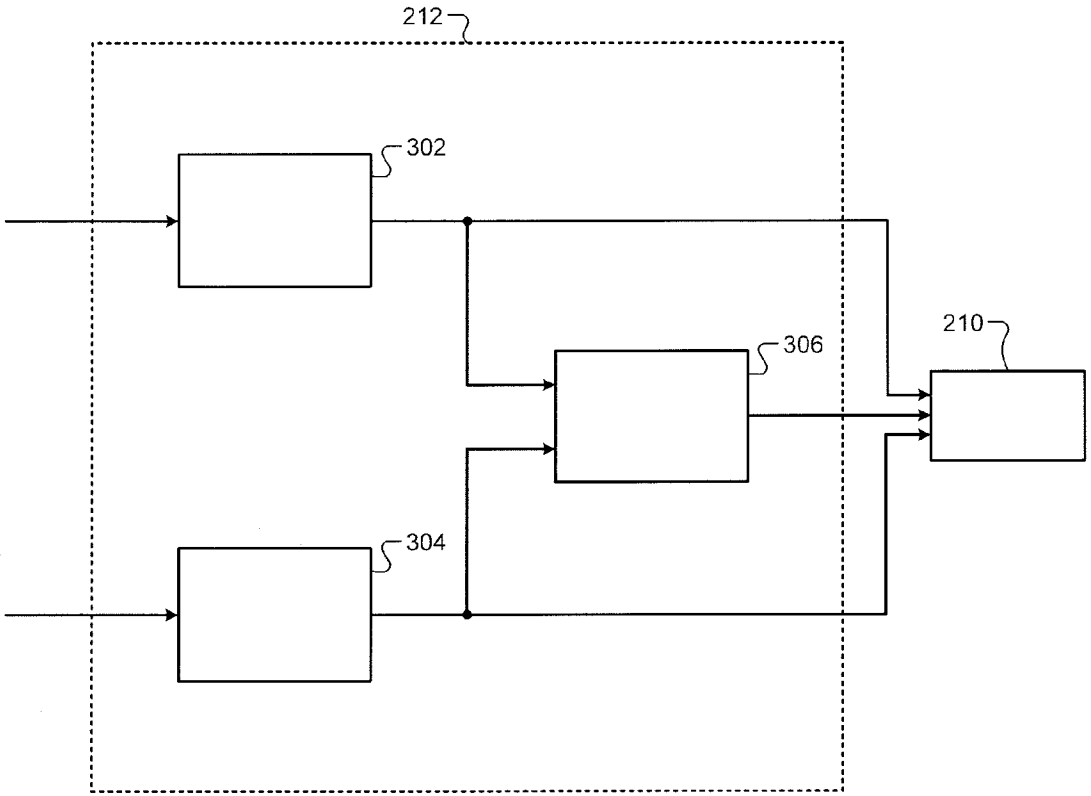
FIG. 3 is a functional block diagram of a first example control module according to the principles of the present disclosure.

Referring now to FIG. 3, an example implementation of the speed trajectory module 212 includes an actual speed determination module 302, a desired speed determination module 304, and a reference speed determination module 306. The actual speed determination module 302 determines an actual speed of the engine 102 during each firing period of the engine 102. A firing period is a period between consecutive firing events. The actual speed determination module 302 may determine the actual speed by sampling input received from RPM sensor 180 every firing period.

The desired speed determination module 304 determines a desired speed of the engine 102 based on one or more known loads that are applied to the engine 102. A known load is a load that is known to the ECM 114 before the load is applied. Conversely, an unknown load is a load that is unknown to the ECM 114 before the load is applied. Unknown loads may include loads applied by a power steering pump (not shown), which may be referred to as power steering loads. Unknown loads may include loads applied by the electric motor 198, which may be referred to as generator loads.

Known loads may include loads applied by the transmission, which may be referred to as transmission loads. The desired speed determination module 304 may receive the known loads from other modules within the ECM 114 and/or from modules outside of the ECM 114. For example, the desired speed determination module 304 may receive the transmission loads from the transmission control module 194.

The desired speed determination module 304 may set the desired speed to an idle speed when the speed mode is enabled. As discussed above, the speed mode may be enabled when the driver removes their foot from the accelerator pedal, such as when the engine 102 is idling or when the vehicle is coasting down from a higher speed. The desired speed determination module 304 may increase the desired speed to a speed that is greater than the idle speed before a known load is applied to prevent the engine 102 from stalling.

The reference speed determination module 306 determines a reference speed based on the actual speed and the desired speed. As discussed above, the speed trajectory module 212 may output a linearly decreasing desired speed for vehicle coastdown until the idle speed is reached, and the linearly decreasing desired speed may be referred to as a reference speed. Although the reference speed is described as linearly decreasing, the reference speed may transition to the idle speed in a nonlinear manner and the reference speed may increase as the reference speed transitions to the idle speed. When the actual speed is equal to the idle speed, the reference speed may be set to the desired speed. The actual speed determination module 302, the desired speed determination module 304, and the reference speed determination module 306 output the actual speed, the desired speed, and the reference speed, respectively.

Figure 4:
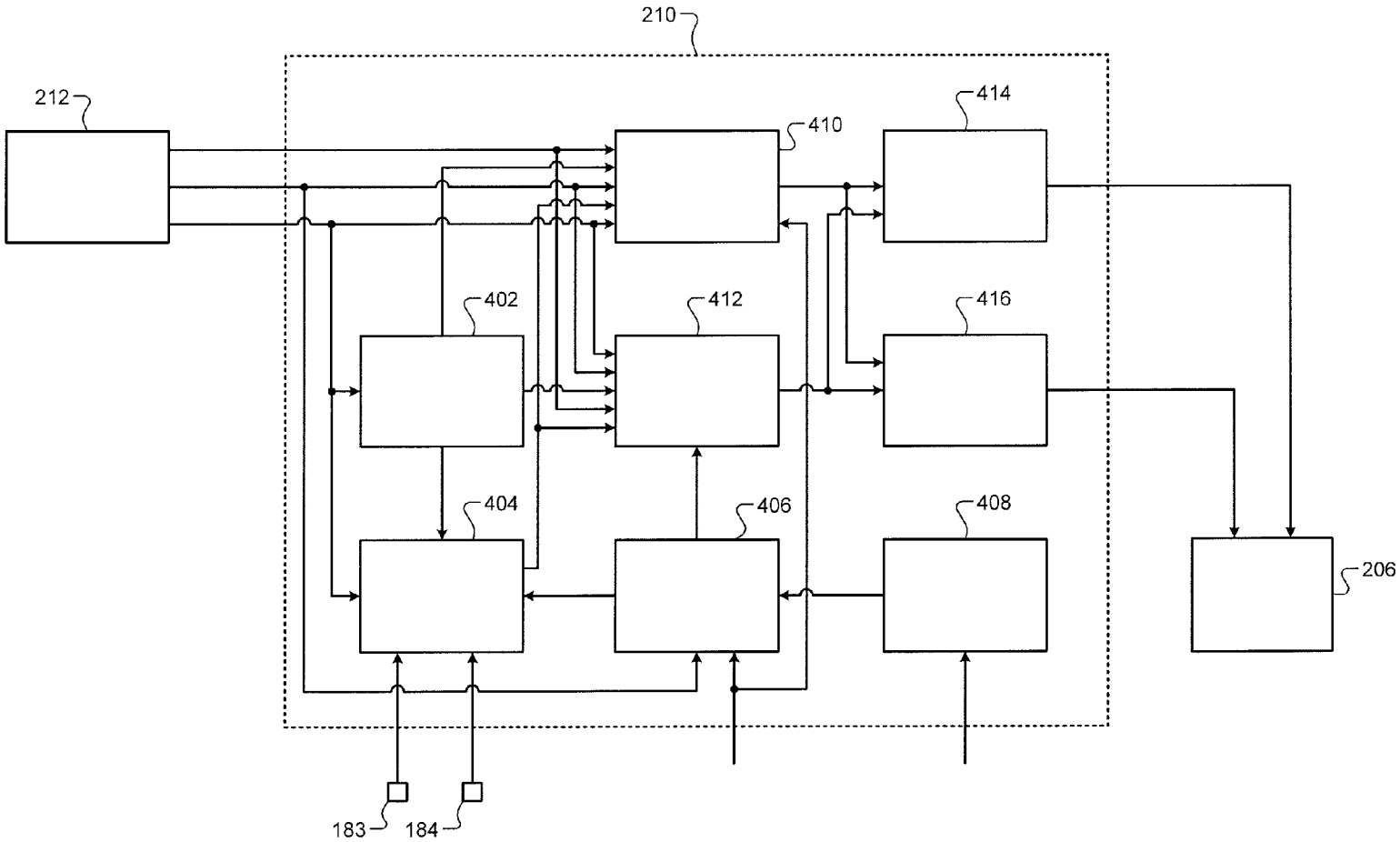
FIG. 4 is a functional block diagram of a second example control module according to the principles of the present disclosure.

Referring now to FIG. 4, an example implementation of the speed control module 210 includes a change rate determination module 402, a transient mode activation module 404, a first rate determination module 406, and a garage shift determination module 408. The change rate determination module 402 determines a change rate of the actual speed of the engine 102. The change rate determination module 402 may determine the change rate by determining a difference between a present engine speed and a previous engine speed, and then dividing the difference by an engine speed sampling period. The change rate determination module 402 outputs the change rate.

The transient mode activation module 404 enables a transient mode when a first condition is satisfied. The first condition may be satisfied when the change rate is greater than a first rate and a pressure ratio across a throttle valve 112 is greater than a first ratio. The transient mode activation module 404 may refrain from enabling the transient mode when the transient mode has been disabled for less than a first period. The first period may be predetermined and may be based on a delay period from a first time when the throttle area is increased to a second time when the manifold absolute pressure increases in response to the throttle area increase. The transient mode activation module 404 outputs a signal indicating when the transient mode is enabled.

The pressure ratio across the throttle valve 112 is a ratio of the ambient air pressure to the manifold absolute pressure. The transient mode activation module 404 may determine the pressure ratio based on input received from the AAP sensor 183 and the MAP sensor 184. Alternatively the transient mode activation module 404 may receive the pressure ratio from a pressure ratio determination module (not shown).

The first rate determination module 406 determines the first rate based on the reference speed, one or more accessory loads, and/or whether a garage shift is in progress. The accessory loads may include loads caused by an A/C compressor clutch and/or a power steering pump. A garage shift is a shift from park or neutral to drive or reverse. The first rate determination module 406 may decrease the first rate when the reference speed decreases, when the accessory loads increase, and/or when a garage shift is in progress. The first rate determination module 406 outputs the first rate.

The garage shift determination module 408 determines whether a garage shift is in progress based on, for example, a gear selector position. The garage shift determination module 408 may receive the gear selector position from a gear selector position (GSP) sensor (not shown) that measures the gear selector position. Additionally or alternatively, the garage shift determination module 408 may determine whether a garage shift is in progress based on input received from the transmission control module 194. The garage shift determination module 408 outputs a signal indicating whether a garage shift is in progress.

A proportional gain determination module 410 and an integral gain determination module 412 determine a proportional gain and an integral gain, respectively. The proportional gain may include a predicted proportional gain and an immediate proportional gain. An immediate torque determination module 414 and a predicted torque determination module 416 may determine the immediate torque and the predicted torque, respectively, which are output by the speed control module 210. The immediate and predicted determination modules 414, 416 may determine the immediate and predicted torques based on the proportional gain and the integral gain.

The predicted torque determination module 416 may determine the predicted torque ($T_{pr}$) based on a zero pedal torque (ZPT), the accessory loads ($L_{acc}$), the integral gain (I), and the predicted proportional gain ($P_{pr}$) using the following relationship:

$$T_{pr}=ZPT+L_{acc}+I+P_{pr}. \quad (3)$$

The zero pedal torque may be the minimum amount of torque that prevents an engine stall when the driver removes their foot from the accelerator pedal.

The immediate torque determination module 414 may determine the immediate torque using different relationships depending on whether the engine 102 is a spark-ignition engine or a compression-ignition engine. For a compression-ignition engine, the immediate torque determination module 414 may determine the immediate torque ($T_{im}$) based on the zero pedal torque (ZPT), the integral gain (I), and the immediate proportional gain ($P_{im}$) using the following relationship:

$$T_{im}=ZPT+I+P_{im}. \quad (4)$$

For a spark-ignition engine, the immediate torque determination module 414 may determine the immediate torque ($T_{im}$) based on the zero pedal torque (ZPT), a filtered integral gain ($I_f$), and the immediate proportional gain ($P_{im}$) using the following relationship:

$$T_{im}=ZPT+I_f+P_{im}. \quad (5)$$

The filtered integral gain may be determined by applying a first-order lag filter to the integral gain. For example, the filtered integral gain ($I_f$) may be determined based on a present integral gain ($I_{prs}$), a previous integral gain ($I_{prv}$), and a filter constant ($K_{f1}$) using the following relationship:

$$I_f=I_{prv}K_{f1}*(I_{prs}-I_{prv}). \quad (6)$$

The proportional gain determination module 410 may determine the predicted proportional gain ($P_{pr}$) based on the actual speed (N), the reference speed ($N_{ref}$), the change rate of the actual speed ($\dot{N}$), predicted proportional constant ($KP_{pr1}$ and $KP_{pr2}$), and a predicted transient constant ($KT_{pr}$) using the following relationship:

$$P_{pr}=KP_{pr1}*f(N-N_{ref})*KP_{pr2}*f(N_{des},\dot{N})*KT_{pr}. \quad (7)$$

This relationship may be embodied as an equation and/or as a lookup table.

The proportional gain determination module 410 may determine the immediate proportional gain ($P_{im}$) based on the actual speed (N), the reference speed ($N_{ref}$), the change rate of the actual speed ($\dot{N}$), immediate proportional constants ($KP_{im1}$ and $KP_{im2}$), and an immediate transient constant ($KT_{im}$) using the following relationship:

$$P_{im}=KP_{im1}*f(N-N_{ref})*KP_{im2}*f(N_{des},\dot{N})*KT_{im}. \quad (8)$$

This relationship may be embodied as an equation and/or as a lookup table.

The integral gain determination module 412 may determine the integral gain (I) based on the actual speed (N), the reference speed (N), the change rate of the actual speed ($\dot{N}$), and an integral constant (KI) using the following relationship:

$$I=KI*f(N-N_{ref})*f(N_{des},\dot{N}). \quad (9)$$

This relationship may be embodied as an equation and/or as a lookup table.

The proportional gain determination module 410 outputs the proportional gain including the predicted proportional gain and the immediate proportional gain. The integral gain determination module 412 outputs the integral gain. The immediate torque determination module 414 outputs the immediate torque. The predicted torque determination module 416 outputs the predicted torque.

Figure 5:
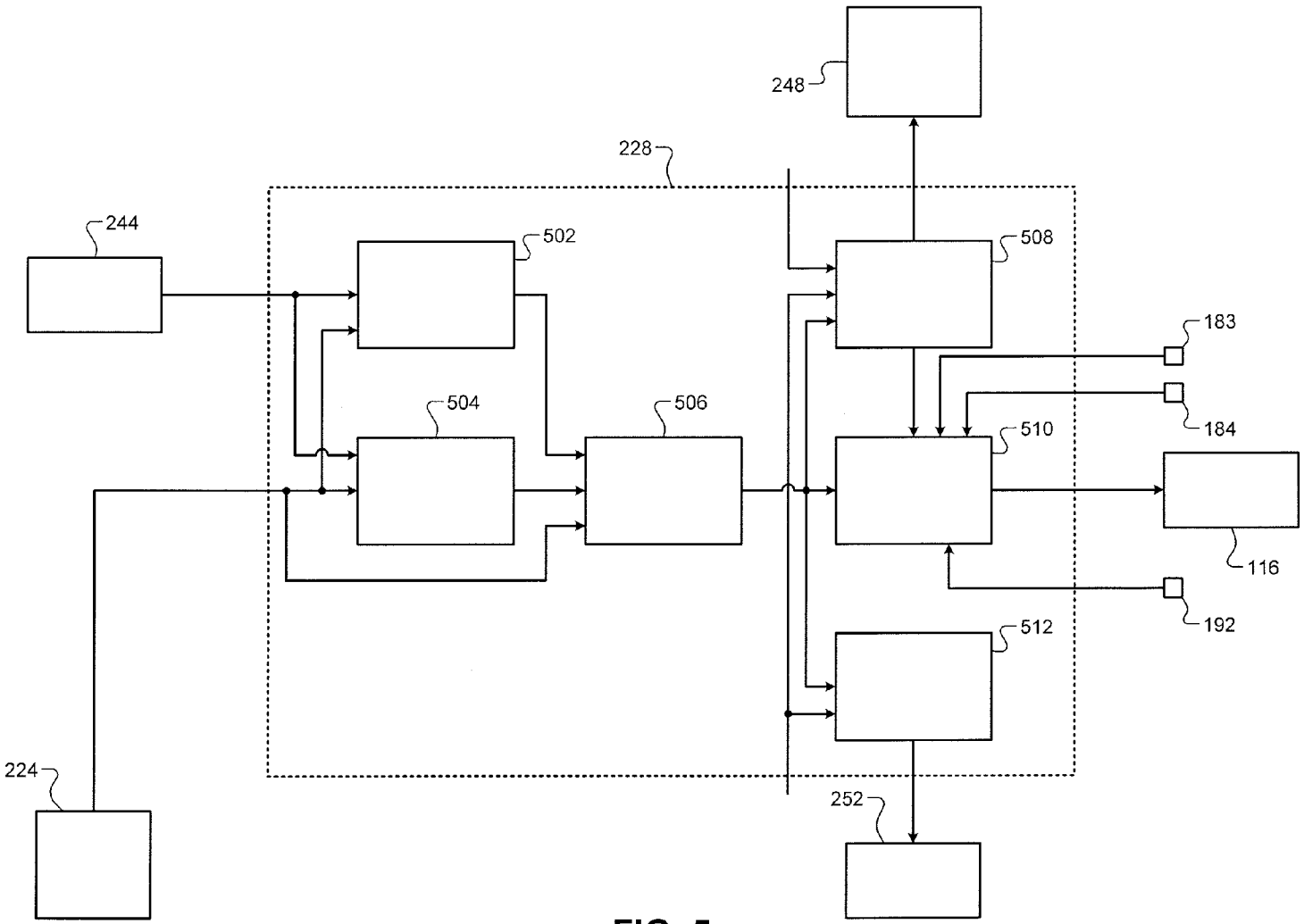
FIG. 5 is a functional block diagram of a third example control module according to the principles of the present disclosure.

Referring now to FIG. 5, an example implementation of the air control module 228 includes a proportional gain determination module 502, an integral gain determination module 504, and a desired torque determination module 506. The proportional gain determination module 502 determines a proportional gain and the integral gain determination module 504 determines an integral gain. The desired torque determination module 506 determines a desired torque based on the proportional gain and/or the integral gain.

The desired torque determination module 506 may determine the desired torque based on the proportional gain and the integral gain during transient conditions such as when the change rate of the actual speed is greater than the first rate. For example, the desired torque determination module 506 may determine the desired torque ($T_{Toes}$) based on the proportional gain (P), the integral gain (I), and the predicted torque ($T_{pr}$) output by the speed control module 210 using the following relationship:

$$T_{des}=T_{pr}+P+I. \quad (10)$$

The desired torque determination module 506 may determine the desired torque based on the proportional gain, but not the integral gain, during steady-state conditions such as when the change rate of the actual speed is less than or equal to the first rate. For example, the desired torque determination module 506 may determine the desired torque ($T_{des}$) based on the proportional gain (P) and the predicted torque ($T_{pr}$) using the following relationship:

$$T_{des}=T_{pr}+P. \quad (11)$$

The proportional gain determination module 502 may determine the proportional gain (P) based on the predicted torque ($T_{pr}$), an actual torque ($T_{act}$), and a proportional constant (KP) using the following relationship:

$$P=KP*f(T_{pr}-T_{act}). \quad (12)$$

This relationship may be embodied as an equation and/or as a lookup table. The actual torque may be the estimated torque that is output by the torque estimation module 244.

The integral gain determination module 504 may determine the integral gain (I) based on the predicted torque ($T_{pr}$), the actual torque ($T_{act}$), and an integral constant (KI) using the following relationship:

$$I=KI*f(T_{pr}-T_{act}). \quad (13)$$

This relationship may be embodied as an equation and/or as a lookup table.

The proportional gain determination module 502 outputs the proportional gain. The integral gain determination module 504 outputs the integral gain. The desired torque determination module 506 outputs the desired torque. A desired MAP determination module 508, a throttle area determination module 510, and a desired APC determination module 512 respectively determine the desired MAP, the throttle area, and the desired APC that are output by the air control module 228. The desired MAP determination module 508, the throttle area determination module 510, and the desired APC determination module 512 may make these determinations based on the desired torque using, for example, an inverse torque relationship. The desired MAP determination module 508 may determine the desired MAP (MAP 1 based on the desired torque ($T_{des}$) and the spark advance (S) using the following relationship:

$$MAP_{des}=f^{-1}(T_{des},S) \quad (14)$$

The desired APC determination module 512 may determine the desired APC based on the desired torque ($T_{des}$), the actual speed (N), and the spark advance (S) using the following relationship:

$$APC_{des}=f^{-1}(T_{des},N,S). \quad (15)$$

This relationship may be embodied as an equation and/or as a lookup table.

During steady-state conditions, the throttle area determination module 510 may determine the throttle area based on the actual MAP to improve engine speed stability. For example, the throttle area ($A_{th}$) may be determined based on the desired APC ($APC_{des}$), the actual speed (N), universal gas constant (R), the intake air temperature (IAT), the ambient air pressure (AAP), a psi filter coefficient (ϕ), the actual MAP ($MAP_{act}$), and a throttle constant ($K_{th}$) using the following relationship:

$$A_{th} = \frac{APC_{des} * N * \sqrt{R * IAT}}{K_{th} * AAP * \Phi * \left(\frac{MAP_{act}}{AAP}\right)}. \quad (16)$$

The throttle area determination module 510 may receive the ambient air pressure, the actual MAP, and the intake air temperature from the AAP sensor 183, the MAP sensor 184, and the IAT sensor 192, respectively.

During transient conditions, the throttle area determination module 510 may determine the throttle area based on the desired MAP to improve engine speed response time. For example, the throttle area ($A_{th}$) may be determined based on the desired APC ($APC_{des}$), the actual speed (N), universal gas constant (R), the intake air temperature (IAT), the ambient air pressure (AAP), a psi filter coefficient (ϕ), the desired MAP ($MAP_{des}$), and a throttle constant ($K_{th}$) using the following relationship:

$$A_{th} = \frac{APC_{des} * N * \sqrt{R * IAT}}{K_{th} * AAP * \Phi * \left(\frac{MAP_{des}}{AAP}\right)}. \quad (17)$$

Figure 6:
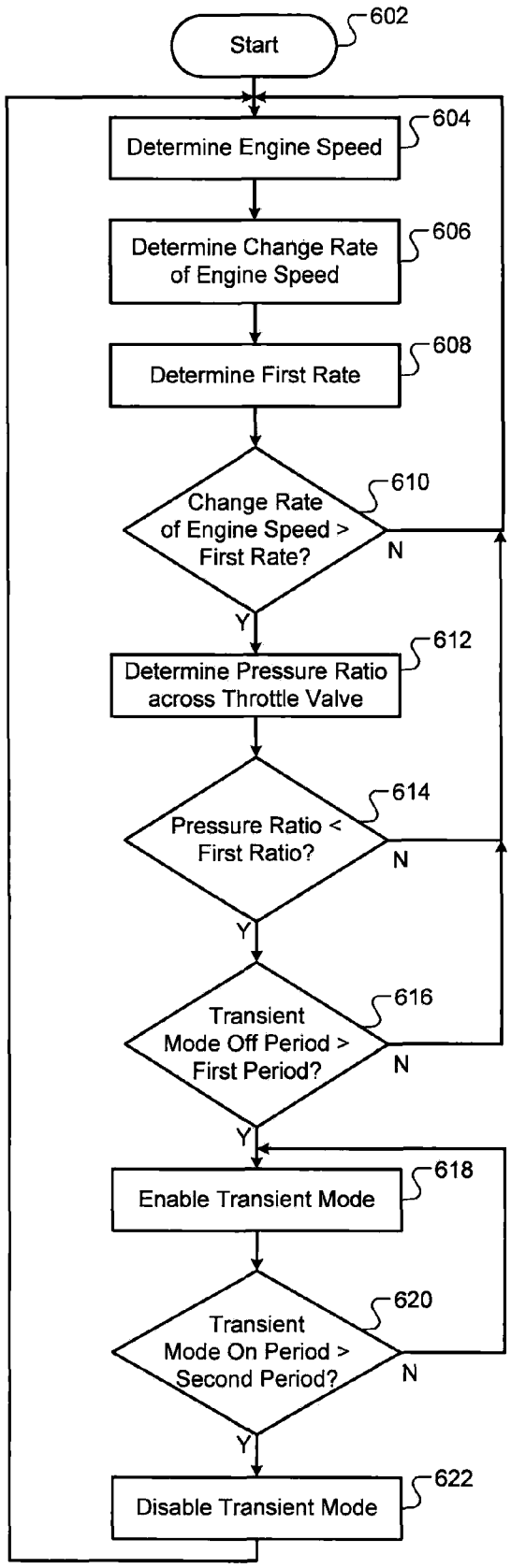
FIG. 6 is a flowchart illustrating a first example control method according to the principles of the present disclosure.

Referring now to FIG. 6, a method for controlling engine speed starts at 602. At 604, the method determines an actual speed of an engine. The method may determine the actual speed by sampling an engine speed signal at least once during every firing period of an engine. A firing period is a period between consecutive firing events and may include the times of the consecutive firing events.

At 606, the method determines a change rate of the actual speed. The method may determine the change rate by determining a difference between a present engine speed and a previous engine speed, and dividing the difference by a period. The period is between a first time when the previous engine speed is determined and a second time when the present engine speed is determined. Thus, if the actual speed is determined by sampling an engine speed signal, the period may be a sampling period.

The method may filter the change rate of the actual speed using a first-order lag filter. For example, the method may determine a filtered change rate ($\dot{N}_f$) based on a present change rate ($\dot{N}_{prs}$), a previous change rate ($\dot{N}_{prv}$), and a filter constant ($K_{f2}$) using the following relationship:

$$\dot{N}_f = \dot{N}_{prv} + K_{f2} * (\dot{N}_{prs} - \dot{N}_{prv}). \quad (18)$$

At 608, the method determines a first rate. The method may determine the first rate based on a desired speed of the engine, an accessory load such as an NC compressor load, and/or whether a garage shift is in progress. A garage shift is a shift from park or neutral to drive or reverse. At 610, the method determines whether the change rate of the actual speed, or the filtered change rate, is greater than the first rate. If the change rate or the filtered change rate is greater than the first rate, the method continues at 612. Otherwise, the method continues at 604.

At 612, the method determines a pressure ratio across a throttle valve. The method may determine the pressure ratio by determining a ratio of first pressure upstream from the throttle valve to a second pressure downstream from the throttle valve. The first pressure may be an ambient pressure or a barometric pressure, and the second pressure may be a pressure within an intake manifold.

At 614, the method determines whether the pressure ratio is greater than a first ratio (e.g., 0.9). The first ratio may be predetermined. If the pressure ratio is greater than the first ratio, the method continues at 616. Otherwise, the method continues at 604. The pressure ratio may be greater than the first ratio and the change rate of the actual speed may be greater than the first rate during a transient condition.

At 616, the method determines whether a transient mode off period is greater than a first period (e.g., 1.5 seconds). The transient mode off period is a period from a first time when a transient mode is disabled to a second time when the determination at 616 is made. If the transient mode off period is greater than the first period, the method continues at 618. Otherwise, the method continues at 604.

When the transient mode is enabled, the throttle area may be increased. The first period may be predetermined based on a delay period from a first time when the throttle area is increased to a second time when the manifold pressure increases in response to the throttle area increase. If the first period is less than the delay period, the transient mode may be enabled two times before the manifold pressure increases in response to the first time that the transient mode is enabled. This may cause an engine speed overshoot, resulting in engine speed oscillations. Therefore, the first period may be greater than or equal to the delay period to improve engine speed stability.

At 618, the method enables the transient mode. The method may incorporate steps discussed below with reference to FIG. 7 when the transient mode is enabled. At 620, the method determines whether a transient mode on period is greater than a second period (e.g., 0.1 seconds). The transient mode on period is a period from a first time when a transient mode is enabled to a second time when the determination at 620 is made. The second period may be predetermined. If the transient mode on period is greater than the second period, the method continues at 622. Otherwise, the method continues at 618. At 622, the method disables the transient mode.

Figure 7:
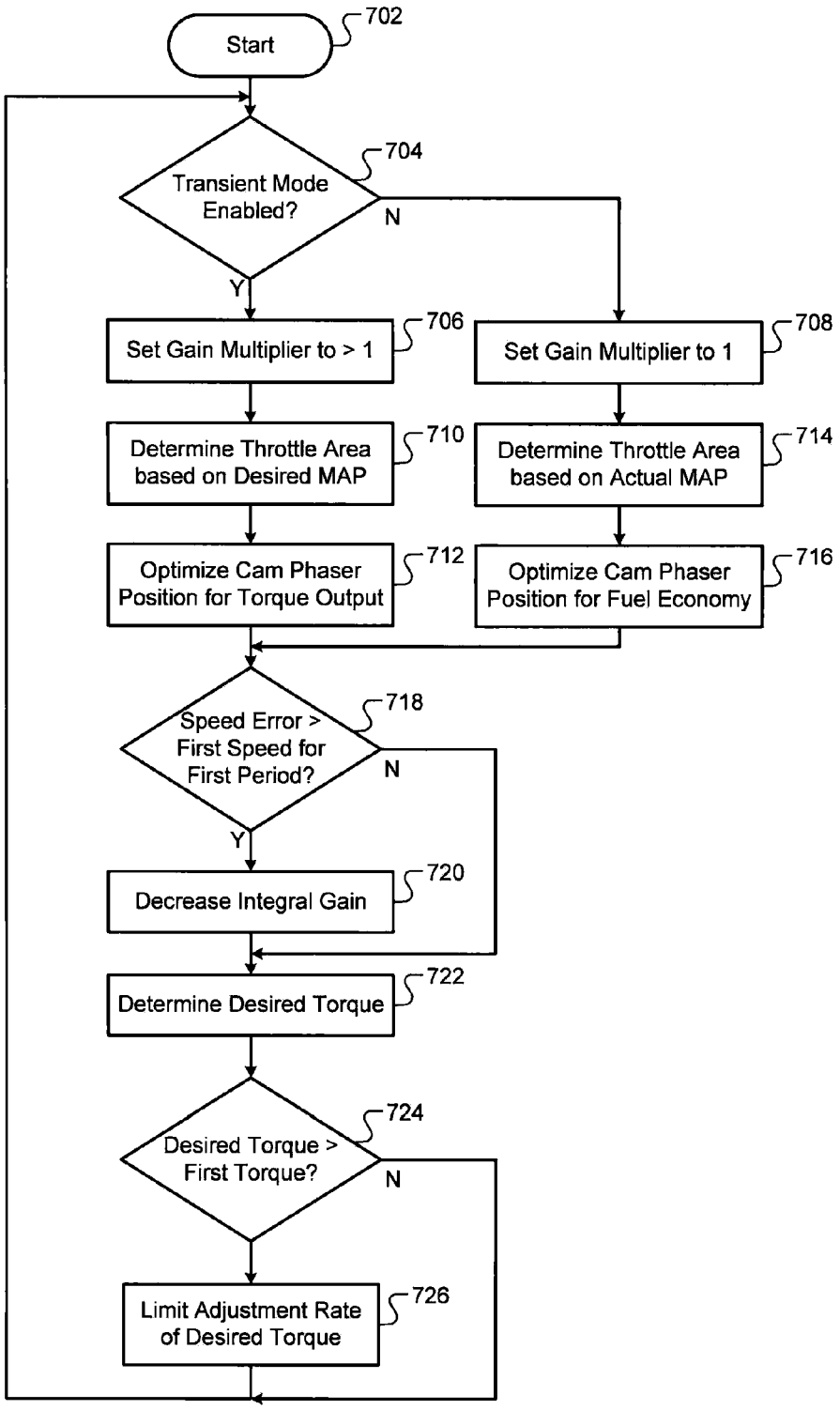
FIG. 7 is a flowchart illustrating a second example control method according to the principles of the present disclosure.

Referring now to FIG. 7, a method for controlling engine speed starts at 702. At 704, the method determines whether a transient mode is enabled. If the transient mode is enabled, the method continues at 706. Otherwise, the method continues at 708. The method may reduce a difference between an actual speed of an engine and a desired speed of an engine by determining a desired torque based on a gain. The desired torque may include an immediate torque and a predicted torque, the gain may include a proportional gain and an integral gain, and the gain may be determined based on a gain multiplier, as discussed above with reference to FIG. 4.

At 706, the method sets the gain multiplier to a value that is greater than one. The gain multiplier may include the predicted transient constant ($KT_{pr}$) and the immediate transient constant ($KT_{im}$) of relationships (7) and (8), discussed above with reference to FIG. 4. At 710, the method determines the throttle area based on a desired MAP. The method may determine the throttle area based on the desired MAP using relationship (17) as discussed above with reference to FIG. 5.

At 712, the method optimizes a cam phaser position for torque output. The cam phaser position may include an exhaust cam phaser position and/or an intake cam phaser position. The method may optimize the cam phaser position for torque output by determining the cam phaser position using a relationship between the cam phaser position and the torque output that maximizes the torque output. This relationship may be predetermined and may be embodied as an equation and/or as a lookup table.

At 708, the method sets (e.g., ramps) the gain multiplier to one. At 714, the method determines the throttle area based on an actual MAP. The method may determine the throttle area based on the actual MAP using relationship (16) as discussed above with reference to FIG. 5. At 716, the method optimizes a cam phaser position for fuel economy. The method may optimize the cam phaser position for fuel economy by determining the cam phaser using a relationship between the cam phaser position and the torque output that maximizes the fuel economy. This relationship may be predetermined and may be embodied as an equation and/or as a lookup table.

At 718, the method determines whether a speed error is greater than a first speed for a first period. The first speed may be a predetermined speed (e.g., 150 RPM) and the first period may be a predetermined period (e.g., 0.5 seconds). If the speed error is greater than the first speed for the first period, the method continues at 720. Otherwise, the method continues at 722. The speed error may be a difference between a reference speed and an actual speed. The reference speed may be equal to a desired speed when a speed mode is enabled and the reference speed may be different from the desired speed during transitions to or from the speed mode. In the speed mode, the method may adjust the torque output of the engine to reduce the speed error.

At 720, the method decreases the integral gain. The method may decrease the integral gain by multiplying the integral gain by a factor (e.g., 0.1, 0.2). The method may decrease the integral gain to reduce integral anti-windup. Decreasing the integral gain when the speed error is greater than the first speed for the first period may prevent engine speed flare and/or engine speed droop.

At 722, the method determines a desired torque. The method may determine the desired torque using relationship (11) as discussed above with reference to FIG. 5. At 724, the method determines whether the desired torque is greater than a first torque. The first torque may be greater than a zero pedal torque by a predetermined amount (e.g., 60 Nm). The zero pedal torque may be the minimum amount of torque that prevents an engine stall when the driver removes their foot from the accelerator pedal.

At 726, the method limits an adjustment rate of the desired torque. When a load is applied to the engine while the driver's foot is removed from the accelerator pedal, the desired torque may increase. In turn, the throttle area may be increased to satisfy the desired torque and the intake manifold may become saturated with airflow. When the load is removed from the engine, the engine speed may increase abruptly. Thus, limiting the adjustment rate of the desired torque may prevent engine speed flare.

The method may set a trajectory of the reference speed to the actual speed during transitions from coast to idle or when a selected gear is park or neutral and the engine speed is less than a predetermined speed (e.g., 1000 RPM). During these periods, the proportional gain is adjusted to decrease the actual speed to the desired speed. Thus, if a load is applied during these periods, the resulting engine speed droop may be sufficient to cause an engine stall.

Setting the trajectory of the reference speed to the actual speed during the periods described above controls the magnitude of the proportional gain. Therefore, if a load is applied during these periods, the resulting engine speed droop is not sufficient to cause an engine stall. The method may set the integral gain to zero when the trajectory of the reference speed is set to the actual speed to prevent torque discontinuities.

The systems and methods described above improve a response time from a first time when engine load changes to a second time when the actual speed is adjusted to the desired speed. The response time is improved by defining a transient condition when predicted and immediate torques can be adjusted faster than the rate at which the predicted and immediate torques are adjusted during a steady-state condition. Improving the response time reduces engine speed droop and engine speed flare.

In addition, the systems and methods increase engine speed stability, thereby reducing engine speed oscillations. Engine speed stability is increased by refraining from enabling a transient mode when the transient mode has been disabled for less than a delay period and by determining the engine speed every firing period. The delay period is a period from a first time when a throttle area is increased to a second time when a manifold pressure increases in response to the throttle area increase.

The systems and methods reduce engine speed droop during power steering cramps, during panic stops, and during launches of a manual transmission. Reducing engine speed droop reduces the amount of time that the actual speed is less than the desired speed. The systems and methods reduce engine speed flare when an A/C compressor clutch is released after a power steering cramp and when a manual transmission clutch is released after the clutch has been depressed for a period.

The foregoing description is merely illustrative in nature and is in no way intended to limit the disclosure, its application, or uses. The broad teachings of the disclosure can be implemented in a variety of forms. Therefore, while this disclosure includes particular examples, the true scope of the disclosure should not be so limited since other modifications will become apparent upon a study of the drawings, the specification, and the following claims. For purposes of clarity, the same reference numbers will be used in the drawings to identify similar elements. As used herein, the phrase at least one of A, B, and C should be construed to mean a logical (A or B or C), using a non-exclusive logical OR. It should be understood that one or more steps within a method may be executed in different order (or concurrently) without altering the principles of the present disclosure.

As used herein, the term module may refer to, be part of, or include an Application Specific Integrated Circuit (ASIC); an electronic circuit; a combinational logic circuit; a field programmable gate array (FPGA); a processor (shared, dedicated, or group) that executes code; other suitable hardware components that provide the described functionality; or a combination of some or all of the above, such as in a system-on-chip. The term module may include memory (shared, dedicated, or group) that stores code executed by the processor.

The term code, as used above, may include software, firmware, and/or microcode, and may refer to programs, routines, functions, classes, and/or objects. The term shared, as used above, means that some or all code from multiple modules may be executed using a single (shared) processor. In addition, some or all code from multiple modules may be stored by a single (shared) memory. The term group, as used above, means that some or all code from a single module may be executed using a group of processors. In addition, some or all code from a single module may be stored using a group of memories.

The apparatuses and methods described herein may be implemented by one or more computer programs executed by one or more processors. The computer programs include processor-executable instructions that are stored on a non-transitory tangible computer readable medium. The computer programs may also include stored data. Non-limiting examples of the non-transitory tangible computer readable medium are nonvolatile memory, magnetic storage, and optical storage.

What is claimed is:

1. A system comprising:

a gain determination module that determines a gain based on a desired speed of an engine and a change rate of an actual speed of the engine;

a desired torque determination module that determines a desired torque based on the gain and a difference between the actual speed and the desired speed; and an engine operation control module that controls at least one of a throttle area, a spark timing, and a fueling rate based on the desired torque.

2. The system of claim 1, wherein the gain includes a proportional gain and an integral gain.

3. The system of claim 2, wherein the gain determination module decreases the integral gain when the difference between the actual speed and the desired speed is greater than a first speed.

4. The system of claim 2, wherein the desired torque determination module refrains from adjusting the desired torque faster than a first rate when the desired torque is greater than a first torque.

5. A system comprising:

a gain determination module that determines a gain based on a desired speed of an engine and a change rate of an actual speed of the engine;

a desired torque determination module that determines a desired torque based on the gain and a difference between the actual speed and the desired speed;

an engine operation control module that controls at least one of a throttle area, a spark timing, and a fueling rate based on the desired torque; and an actual speed determination module that determines the actual speed during consecutive firing periods, wherein a firing period is a period between consecutive firing events.

6. A system comprising:

a gain determination module that determines a gain based on a desired speed of an engine and a change rate of an actual speed of the engine;

a desired torque determination module that determines a desired torque based on the gain and a difference between the actual speed and the desired speed; and an engine operation control module that controls at least one of a throttle area, a spark timing, and a fueling rate based on the desired torque, wherein the gain determination module selectively increases the gain when a first condition is satisfied, and the first condition is satisfied when a pressure ratio across a throttle valve is less than a first ratio and the change rate of the actual speed is less than a first rate.

7. The system of claim 6, further comprising a first rate determination module that determines the first rate based on at least one of the desired speed, an accessory load, and whether a garage shift is in progress, wherein the garage shift is a transmission shift from one of park and neutral to one of drive and reverse.

8. The system of claim 6, wherein the gain determination module increases the gain for a first predetermined period that is based on a delay between a throttle area increase and a manifold pressure increase in response to the throttle area increase.

9. The system of claim 8, wherein the gain determination module stops increasing the gain when the first predetermined period ends and refrains from increasing the gain for a second predetermined period after the first predetermined period ends.

10. The system of claim 6, further comprising a throttle area determination module that determines the throttle area based on a desired manifold pressure when the first condition is satisfied.

11. A method comprising:

determining a gain based on a desired speed of an engine and a change rate of an actual speed of the engine;

determining a desired torque based on the gain and a difference between the actual speed and the desired speed; and controlling at least one of a throttle area, a spark timing, and a fueling rate based on the desired torque.

12. The method of claim 11, wherein the gain includes a proportional gain and an integral gain.

13. The method of claim 12, further comprising decreasing the integral gain when the difference between the actual speed and the desired speed is greater than a first speed.

14. The method of claim 12, further comprising refraining from adjusting the desired torque faster than a first rate when the desired torque is greater than a first torque.

15. A method comprising:

determining a gain based on a desired speed of an engine and a change rate of an actual speed of the engine;

determining a desired torque based on the gain and a difference between the actual speed and the desired speed;

controlling at least one of a throttle area, a spark timing, and a fueling rate based on the desired torque; and determining the actual speed during consecutive firing periods, wherein a firing period is a period between consecutive firing events.

16. A method comprising:

determining a gain based on a desired speed of an engine and a change rate of an actual speed of the engine;

determining a desired torque based on the gain and a difference between the actual speed and the desired speed;

controlling at least one of a throttle area, a spark timing, and a fueling rate based on the desired torque; and selectively increasing the gain when a first condition is satisfied, wherein the first condition is satisfied when a pressure ratio across a throttle valve is less than a first ratio and the change rate of the actual speed is less than a first rate.

17. The method of claim 16, further comprising determining the first rate based on at least one of the desired speed, an accessory load, and whether a garage shift is in progress, wherein the garage shift is a transmission shift from one of park and neutral to one of drive and reverse.

18. The method of claim 16, further comprising increasing the gain for a first predetermined period that is based on a delay between a throttle area increase and a manifold pressure increase in response to the throttle area increase.

19. The method of claim 18, further comprising stop increasing the gain when the first predetermined period ends and refraining from increasing the gain for a second predetermined period after the first predetermined period ends.

20. The method of claim 16, further comprising determining the throttle area based on a desired manifold pressure when the first condition is satisfied.

* * * * *